US006549139B2

(12) United States Patent
Shaw, Jr.

(10) Patent No.: US 6,549,139 B2
(45) **Date of Patent: *Apr. 15, 2003**

(54) CRANE SAFETY DEVICE AND METHODS

(76) Inventor: Jack B. Shaw, Jr., c/o 2710 Bedford St., Johnstown, PA (US) 15904

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/383,192

(22) Filed: Aug. 26, 1999

(65) Prior Publication Data

US 2002/0175824 A1 Nov. 28, 2002

Related U.S. Application Data

(63) Continuation of application No. PCT/US98/03482, filed on Feb. 26, 1998, which is a continuation-in-part of application No. 09/030,249, filed on Feb. 25, 1998, now Pat. No. 6,140,930

(60) Provisional application No. 60/039,825, filed on Feb. 27, 1997.

(51) Int. Cl.[7] ..... G08B 21/00

(52) U.S. Cl. ..... 340/685; 212/276; 701/50

(58) Field of Search ..... 340/685, 669, 340/670, 671, 673, 677, 691.1, 692, 425.5, 431, 436, 438, 463, 467, 468, 474; 212/276, 277, 279; 701/50

(56) References Cited

U.S. PATENT DOCUMENTS

| | | | | |
|---|---|---|---|---|
| 3,693,360 A | | 9/1972 | Holder | 405/211 |
| 3,815,116 A | | 6/1974 | Fink | 340/666 |
| 3,823,395 A | | 7/1974 | Rigney et al. | 340/531 |
| 3,848,750 A | * | 11/1974 | Hoge | 212/277 |
| 3,969,714 A | | 7/1976 | Greer | 340/539 |

(List continued on next page.)

FOREIGN PATENT DOCUMENTS

| | | |
|---|---|---|
| EP | 0 072 567 A2 | 2/1983 |
| FR | 76 05946 | 9/1977 |
| JP | 58-42600 | 3/1983 |
| JP | 07-81887 | 3/1995 |
| JP | 8-324965 | 12/1996 |
| NL | 8503113 | 6/1987 |
| WO | WO 98/55388 | 12/1998 |

OTHER PUBLICATIONS

U.S. Department of Labor, Occupational Safety and Health Administration. Regulations (Standards—29 CFR), Cranes and derricks–1917.45 (17 pages).

James R. Guenther, "Interpretation on standards for use of cranes during high wind condition," Mar. 26, 1985, OSHA Occupational Safety & Health Administration U.S. Departmnet of Labor, pp. 1–4.

*Primary Examiner*—Toan Pham
(74) *Attorney, Agent, or Firm*—Banner & Witcoff, Ltd.

(57) ABSTRACT

An improved crane warning system which includes acceleration sensors, motion sensors, hydraulic sensors, remote communications and/or a camera. The crane warning system may include a crane warning device integrated into the ball of the crane.

102 Claims, 8 Drawing Sheets

U.S. PATENT DOCUMENTS

| | | | | | |
|---|---|---|---|---|---|
| 4,178,591 | A | | 12/1979 | Geppert | 340/685 |
| 4,183,708 | A | | 1/1980 | Kuhbier et al. | 414/543 |
| 4,236,864 | A | * | 12/1980 | Couture et al. | 414/699 |
| 4,238,037 | A | | 12/1980 | Azovtsev et al. | 212/149 |
| 4,281,342 | A | | 7/1981 | Ueda | 348/94 |
| 4,300,134 | A | | 11/1981 | Paciorek | 340/685 |
| 4,303,973 | A | | 12/1981 | Williamson, Jr. et al. | 364/103 |
| 4,424,909 | A | * | 1/1984 | Bergeron | 212/280 |
| 4,454,757 | A | | 6/1984 | Weinstein et al. | 73/170.11 |
| 4,516,117 | A | | 5/1985 | Couture et al. | 340/685 |
| 4,752,012 | A | | 6/1988 | Juergens | 212/154 |
| 4,788,534 | A | | 11/1988 | Engelhardt | 340/601 |
| 4,833,615 | A | | 5/1989 | Bitner et al. | 701/124 |
| 4,849,778 | A | | 7/1989 | Samuelson | 396/428 |
| 4,896,370 | A | | 1/1990 | Kasparian et al. | 455/77 |
| 5,019,798 | A | | 5/1991 | Pherigo, Jr. | 340/326 |
| 5,042,959 | A | | 8/1991 | Tadatsu | 405/191 |
| 5,058,752 | A | | 10/1991 | Wacht et al. | 212/278 |
| 5,067,013 | A | | 11/1991 | Lindholm et al. | 348/94 |
| 5,089,972 | A | | 2/1992 | Nachman et al. | 700/218 |
| 5,152,408 | A | | 10/1992 | Tax et al. | 212/270 |
| 5,198,800 | A | | 3/1993 | Tozawa et al. | 340/573.1 |
| 5,211,245 | A | | 5/1993 | Relyea et al. | 169/24 |
| 5,217,126 | A | | 6/1993 | Hayashi et al. | 212/153 |
| 5,220,499 | A | | 6/1993 | Kawamori | 700/83 |
| 5,353,400 | A | | 10/1994 | Nigawara et al. | 395/161 |
| 5,371,895 | A | | 12/1994 | Bristol | 717/136 |
| 5,392,935 | A | | 2/1995 | Kazama et al. | 212/278 |
| 5,400,246 | A | | 3/1995 | Wilson et al. | 364/146 |
| 5,485,620 | A | | 1/1996 | Sadre et al. | 717/162 |
| 5,504,880 | A | | 4/1996 | Hirosawa et al. | 709/224 |
| 5,506,787 | A | | 4/1996 | Muhlfeld et al. | 700/181 |
| 5,517,404 | A | | 5/1996 | Biber et al. | 364/138 |
| 5,526,268 | A | | 6/1996 | Tkacs et al. | 704/8 |
| 5,537,605 | A | | 7/1996 | Teece | 712/1 |
| 5,539,650 | A | | 7/1996 | Hehl | 700/200 |
| 5,594,858 | A | | 1/1997 | Blevins | 345/747 |
| 5,646,343 | A | | 7/1997 | Pritchard | 73/170.08 |
| 5,729,453 | A | | 3/1998 | Lee et al. | 701/50 |
| 5,731,974 | A | | 3/1998 | Pietzsch et al. | 700/83 |
| 5,823,370 | A | | 10/1998 | Ueda | 212/276 |
| 6,140,930 | A | * | 10/2000 | Shaw | 340/685 |

* cited by examiner

CRANE SAFETY DEVICE AND METHODS

This application is a continuation application of co-pending International Application No. PCT/US98/03482, entitled "Crane Safety Devices and Methods," filed Feb. 26, 1998, which is a continuation-in-part of U.S. patent application Ser. No. 09/030,249, now U.S. Pat. No. 6,140,930, entitled "Crane Safety Devices and Methods," filed Feb. 25, 1998, which is based on U.S. Provisional Application Ser. No. 60/039,825, entitled "Crane Safety Devices and Methods," filed Feb. 27, 1997, now abandoned, which are all hereby incorporated by reference in their entireties.

TECHNICAL FIELD

The present invention relates to crane safety methods and devices and, in particular, to improved safety devices and methods which warn workers of the movement of portions of a crane.

BACKGROUND OF THE INVENTION

Conventional crane safety devices (e.g., U.S. Pat. No. 5,019,798) are subject to a number of deficiencies. For example, the devices must be manually attached to the load each time that a new load is secured to the crane. Further, a warning beacon on the safety device often becomes obscured by the load, especially where the load is large or of an unusual shape. Further, the warning indicators on the device are always active whether or not the load is actually in motion. This condition is dangerous because is does not sufficiently warn the workman when the ball is in motion. Because of these disadvantages, crane safety devices mounted proximate to the moving crane parts have not been widely utilized. Accordingly, there is a need for an improved crane safety device.

SUMMARY OF THE INVENTION

One aspect of the invention is to provide an acceleration sensor within the crane warning device which activates the crane warning device whenever the ball of the crane is being accelerated in any direction. For example, a mercury switch, a piezo-electric sensor, or other conventional acceleration sensor may be utilized to determine when the ball of the crane is accelerating.

Another aspect of the invention is to include a sensor which detects constant velocity motion of the ball of the crane. This sensor may be utilized in addition to or instead of the acceleration detector coupled to the ball of the crane. The motion sensor may be wholly contained within a housing of the warning device or it may be distributed at other locations in the crane such as by coupling portions of the warning device to one or more other electro-mechanical components of the crane. In one aspect of the invention, portions of the motion sensor are coupled to one or more hydraulic systems in the crane and actuated appropriately whenever the hydraulic system is actuated to move the ball of the crane. In yet other aspects of the invention, portions of the motions sensor are coupled to the electronic control system of the crane. In still other aspects of the invention, the mechanisms for detecting motion are mounted remotely and communicate with the warning device using electromagnetic waves such as radio waves.

In yet other aspects of the invention, fail-safe mechanisms may be built into the crane warning device such that the warning device is activated whenever a sensor fails or loses contact (e.g., radio contact) with the warning device.

Further, a crane warning device status monitor may be built into the cabin of the crane so that the operator may be warned of any operational problems with any of the sensors in a timely fashion.

In still further aspects of the invention, the crane warning device may be mounted to maximize its utilization and resulting safety such as by integrating the crane warning device directly into the ball of the crane. In still further aspects, the warning device may be removably or fixedly attached to the side of the crane (e.g., by bolting or magnetically attaching the device to one or more sides of the counter weight).

In still further aspects of the invention, multiple crane warning devices are coupled to the crane in different locations so as to maximize safety. For example, one crane warning device may be located on the ball, and second, third, and/or fourth crane warning devices respectively mounted on first, second, and third sides of the crane counter weight. In yet other aspects of the invention, the audible and visual warning indicators from all of the crane warning devices may be synchronized such that the "beep" noise and/or the strobe light from all of the crane warning devices are coincident.

In still further aspects of the invention, a microphone and speaker system is included in the crane warning device such that the operator can communicate with the workers. Worker safety is vastly increased because the worker may use both hands to manipulate the load while verbally signaling the operator. In further aspects of the invention, the a camera may be mounted such that a "birds eye" view of the load/ball may be obtained by the operator sitting in the cab from a remotely mounted camera. The birds eye view, alone or in conjunction with the audio communications, vastly increases safety and efficiency of the crane operating environment. Additionally, in other aspects of the invention, electronics in the warning device may electronically filter the noise from the crane audible warning device so as not to interfere with normal communication with the crane operator. The filtering eliminates the beeping emitted from the warning device without filtering out the normal voice of the operator and/or worker. In still further aspects of the invention, the crane warning devices are mounted on different sides of the crane so that the operator has immediate communications with all sides of the crane, further enhancing safety.

Although the invention has been defined using the appended claims, these claims are exemplary and not limiting in that the invention is meant to include one or more elements from the apparatus and methods described herein in any combination or subcombination. Accordingly, there are any number of alternative combinations for defining the invention, which incorporate one or more elements from the specification (including the drawings) in various combinations or subcombinations.

DESCRIPTION OF PREFERRED EMBODIMENTS

Figure 1:
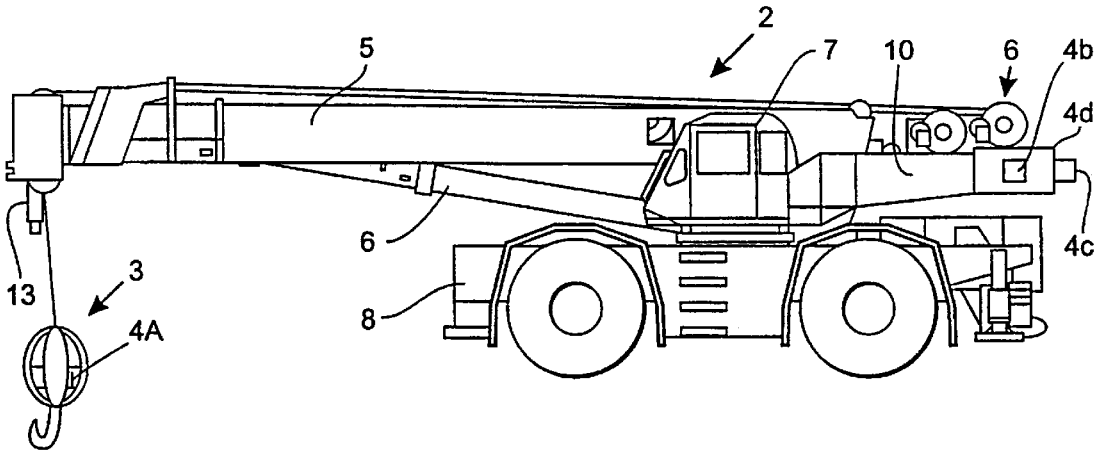
FIG. 1 is a perspective view of a crane incorporating aspects of the crane warning system.
Figure 2:
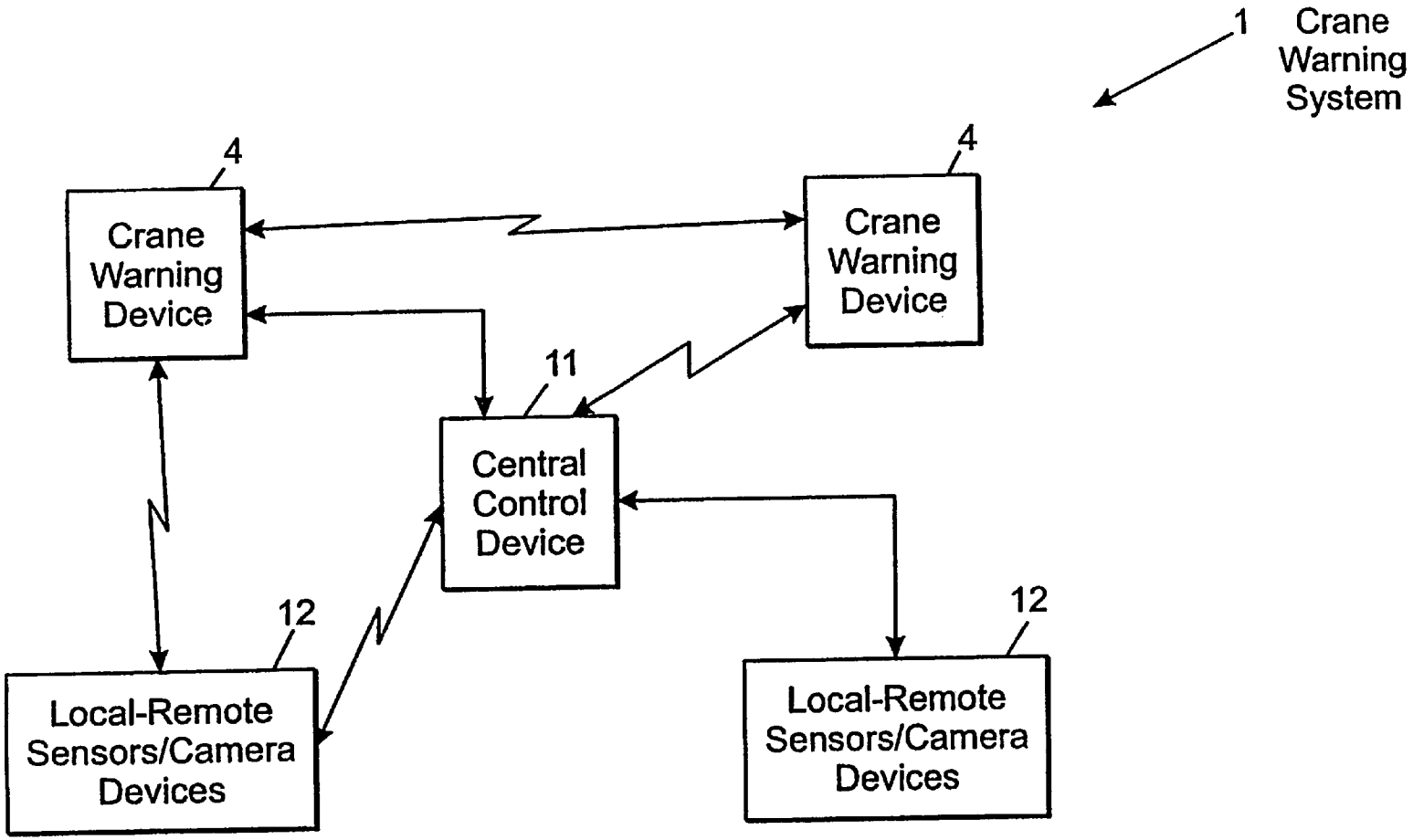
FIG. 2 is a block diagram of a crane warning system incorporating a plurality of crane warning devices, a central control device, and a plurality of remote sensors.

Referring to FIGS. 1 and 2, a crane warning system 1 is incorporated in a crane 2 to improve the safety of workers (not shown) in the vicinity of the crane. The crane 2 typically includes a boom 5, various movement mechanisms 6 to move the boom 5, carriage (not shown in the embodiment of FIG. 1), and/or ball 3 in any one of a plurality of direction. The movement mechanisms may include any hydraulic, electromotive, mechanical, and/or other mechanisms well known in the art to cause motion of the ball 3, boom 5, and/or carriage (not shown). For the purposes of this specification, the boom includes any jib or other extension which may be attached to the boom. The crane 2 typically includes a cab 7 for accommodating an operator (not shown). In many cases, the cab 7 is either partially or completely enclosed to provide a controlled environment for the operator. The crane 2 may include one or more crane warning devices 4 strategically disposed about the crane 2. In the embodiment shown in FIG. 1, the crane warning device 4A is incorporated directly into the ball 3 of the crane 2. Alternatively, the crane warning device 4 may be located at other strategic locations such as on the counter weight 10. In the embodiment illustrated in FIG. 1, there are three crane warning devices 4*b* located on three different sides of the counter weight 10.

Disposing a crane warning device on the crane counter weight is particularly advantageous where the crane is used in an urban area. Often the crane is positioned in the street adjacent to the sidewalk. Pedestrians are often routed around the crane using orange warning cones. However, in order to keep from being injured by cars, pedestrians often stand within the cones while waiting for cars to pass. These pedestrians are often oblivious to the fact that when the crane turns, a large counter weight also swings out into the street where they are standing. Thus, the crane warning devices 4*b* disposed on the counter weight 10 are particularly advantageous. The crane warning device 4*b* may be located directly on the counter weight using any suitable method such as bolting, strapping, or magnetic attachment. The crane warning device may also be mounted toward the back of the counter weight so as to be near the portion of the counter weight which extends furthermost from the crane as the counter weight turns.

Referring specifically to FIG. 2, one or more of the crane warning devices 4 may operate in isolation or may be coupled to one or more other devices. Where the crane warning devices 4 are coupled to other devices, they may be coupled to a central control device 11, one or more other crane warning devices 4, and/or one or more remote sensors/camera units 12. Where a central control device 11 is utilized, the central control device 11 may be directly or indirectly coupled to one or more remote sensors and/or camera units 12. The connections between the crane warning devices 4, the central control device 11, and remote sensors and/or camera units 12, 13 may be accomplished using any suitable mechanism such as electromagnetic transmission (e.g., radio waves) and/or direct electrical and/or optical connections.

Where a remote camera 13 is utilized, the remote camera may be mounted in any suitable location such as on the boom, ball, cable, carriage, etc. In many embodiments, the remote camera 13 may be mounted such that a birds eye view is presented to the operator in the cab such that the operator can see all around the load and is not restricted to viewing only one side of the load. In this manner, where the worker stands on the far side of the load, the operator can view the workers actions and position relative to the load. The camera 12, 13 may be equipped with a zoom lens to zoom-in on the work area which may be either remote controlled and/or controlled based on the current location of the ball. In other words, the zoom lense may be adjusted such that the zoom feature tracks the current location of the ball with little zoom where the ball is close to the boom and increased zoom where the ball is remote from the boom. The remote camera 12, 13 may also be equipped with a laser range finder which determines the location of the ground level relative to the boom and relays this information back to the central controller. The controller may cause the raising and lowering of the ball to be at a rapid rate until the ball approaches the ground or target level and then automatically slow the decent. Similarly, the range finder may be positioned directly over the ball and be directed at the ball where a second range finder is directed to the side of the ball at the ground or target location so that the controller is able to determine the relative distance between the ball and the ground or target location.

Figure 4:
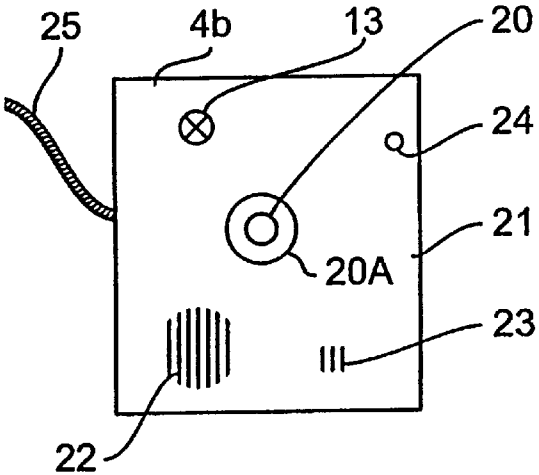
FIGS. 3–5 are perspective views of first, second, and third embodiments of a crane warning devices incorporating aspects of the present invention.
Figure 3:
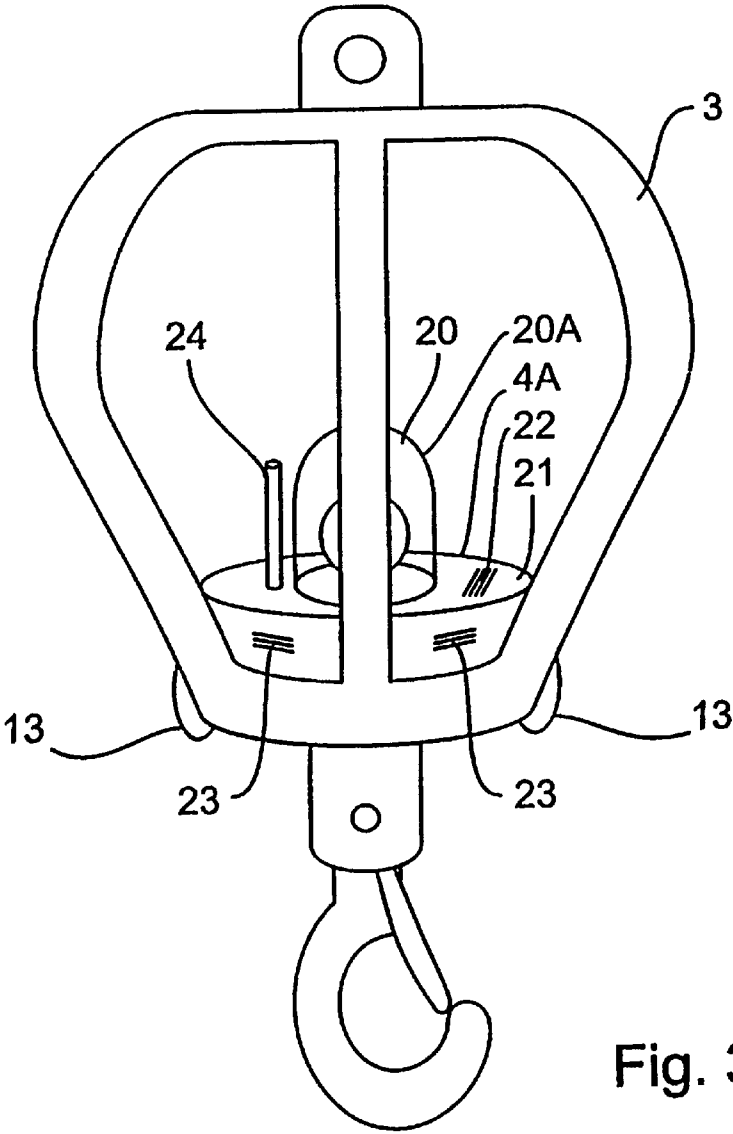
Figure 5:
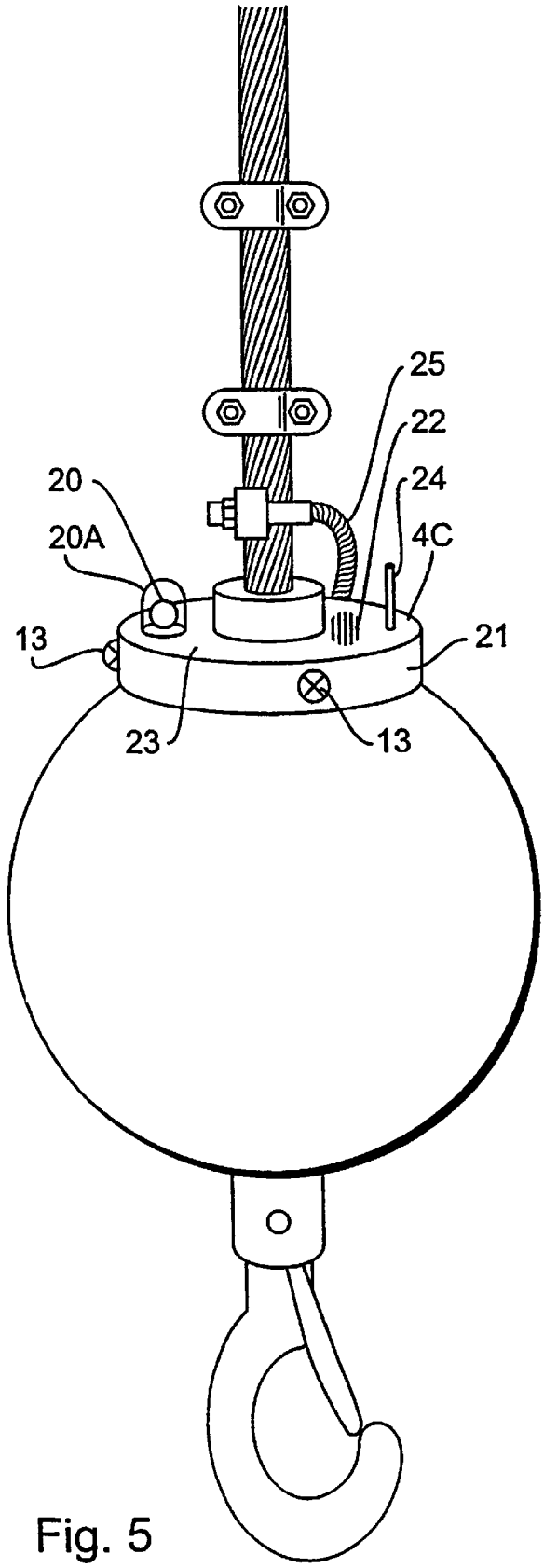

Referring to FIGS. 3–5, three different embodiments of the crane warning device 4 are shown. The crane warning devices 4A, 4B, and 4C may include a beacon light 20, one or more audible warning devices 22 (speakers), one or more audio processor devices 23 (microphones), a transmit/receive mechanism 25 (antenna), a tether 24, and/or one or more remote sensor/camera devices 13 coupled to an enclosure 21. With regard to FIG. 3, the crane warning device 4A is incorporated directly into the ball 3 of the crane 2. Where the crane warning device is integrated into the ball of the crane, visibility of the warning light is maximized and a centralized audible warning noise is advantageously provided to minimize interference of the load with the warning device. When integrated into the ball, the warning device remains visible form substantially all angles, e.g., 360 degrees. With regard to FIG. 4, the crane warning device may be incorporated in an enclosure 21 and mounted about the crane such as on one or more sides of the counterweight 10. In the embodiment of FIG. 5, the crane warning device may be positioned above the ball 3. In the embodiments of FIGS. 4 and 5, it may be desirable to incorporate a magnet into the base of the crane warning device to facilitate attachment to the ball or counterweight of the crane. In this manner, it is a simple task to retrofit cranes with a suitable crane warning device.

Figure 6:
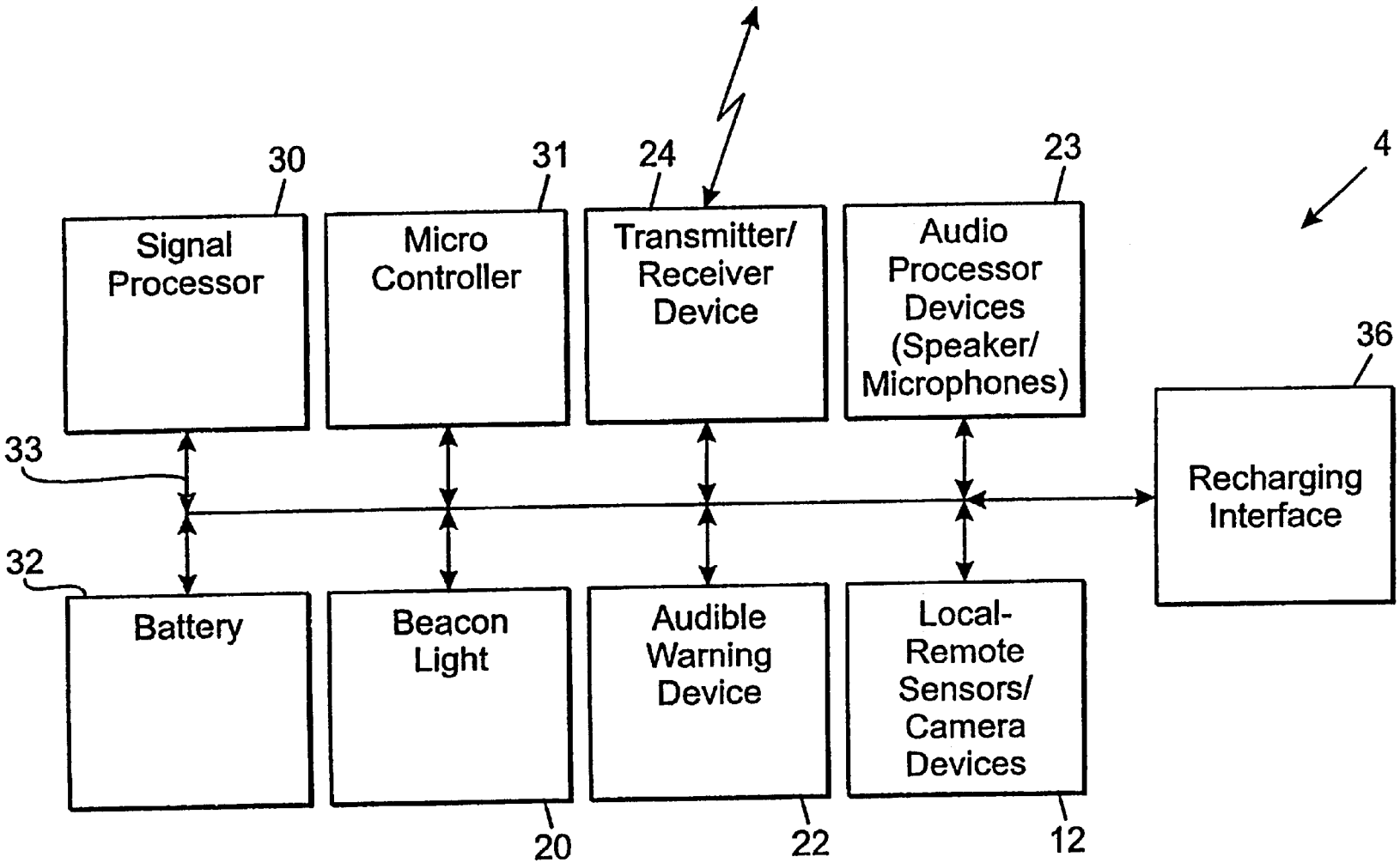
FIG. 6 is a block diagram of an embodiment of the crane warning device.
Figure 7:
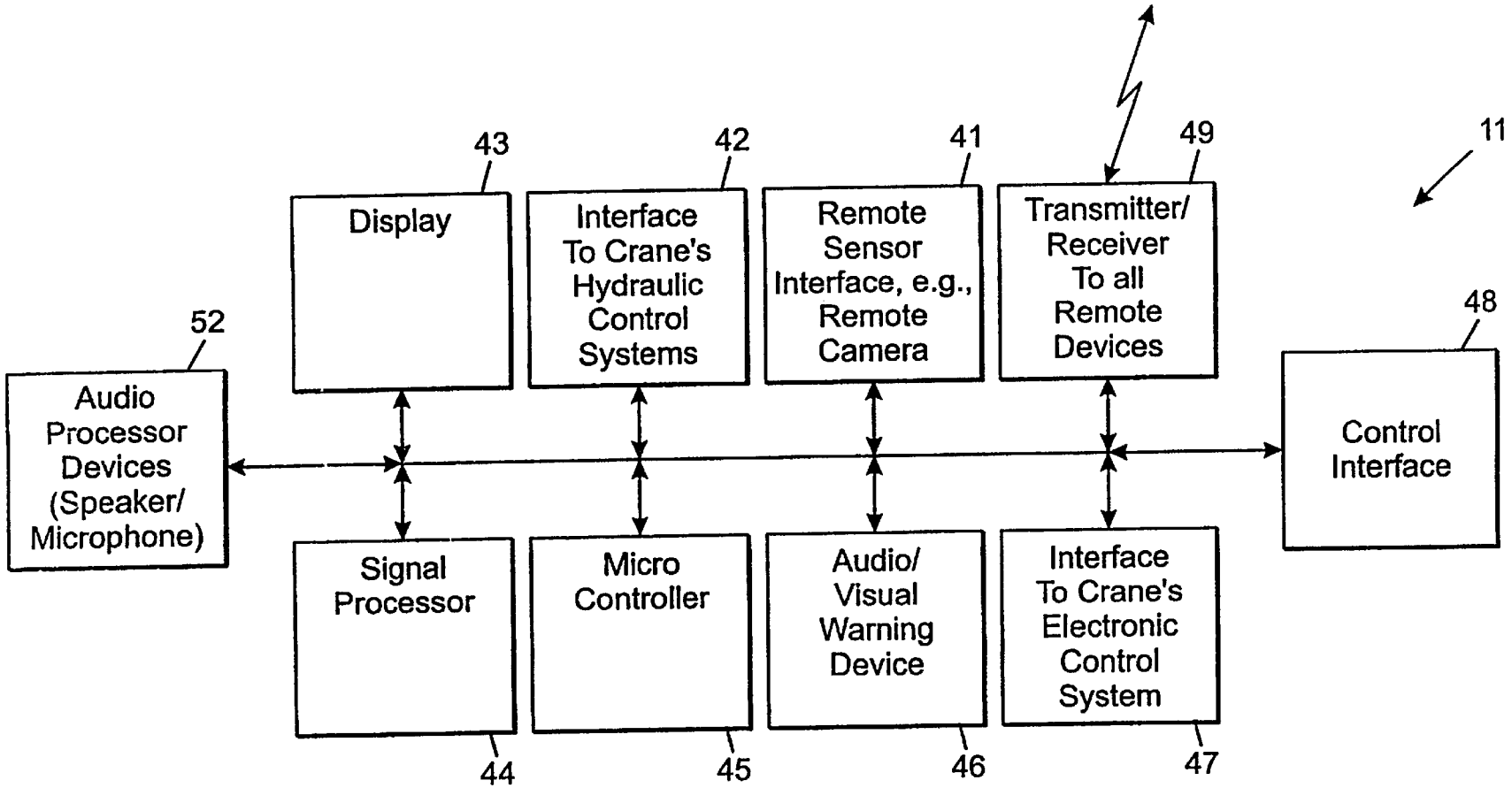
FIG. 7 is a block diagram of a central control device.
Figure 8:
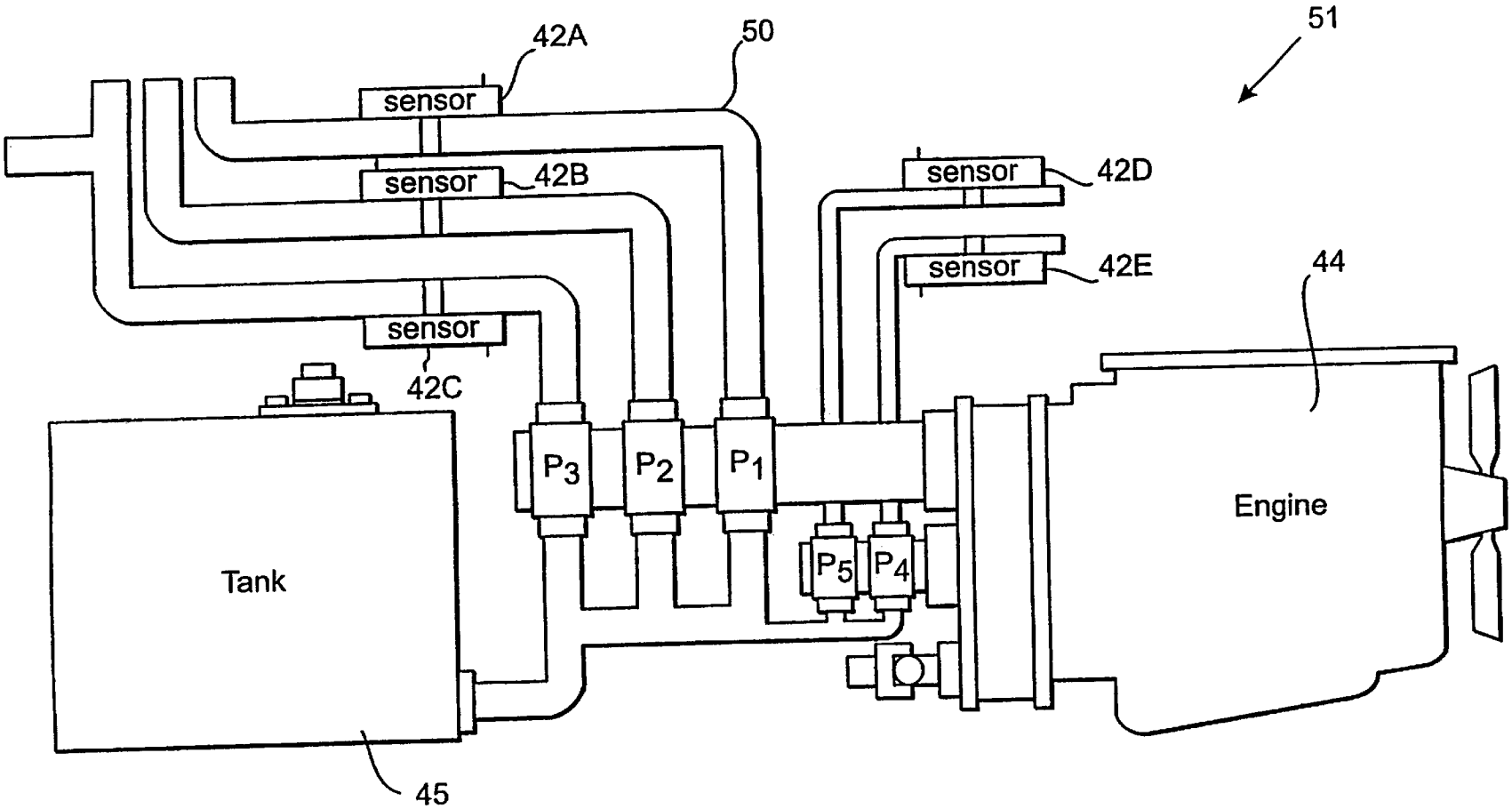
FIG. 8 is a partial schematic, partial block diagram of a remote sensor arrangement coupled to a hydraulic system in the crane.

Referring to FIG. 6, an exemplary block diagram of one embodiment of the crane warning device 4 is shown. The crane warning device may include the beacon light 20, the audible warning device 22, the local and/or remote sensors/camera device 12, 13, audio processor devices 23, transmitter/receiver device 24, a signal processor 30, a microcontroller 31, a recharging interface 36, and a battery 32 interconnected via one or more system busses 33. FIG. 7 shows an exemplary block diagram of one embodiment of the central control device 11. The central control device 11 may include a signal processor 44, a microcontroller 45, an audio/visual warning device 46, an interface to the crane's electronic control system 47, a control interface 48, a transmitter/receiver 49, a remote sensor interface 41, a hydraulic control interface 42, and a display 43. FIG. 8 shows an exemplary embodiment of the hydraulic system 51 of the crane 2 where hydraulic sensors 42A–42E are coupled to a hydraulic system incorporating a tank 45, a plurality of pumps P1–P6, an engine 44, and a plurality of hydraulic lines 50. The crane warning devices 4 and the central control device 11 may be variously configured to include any subset of the devices shown in the block diagrams or FIGS. 1–9 in any subcombination.

The beacon light 20 may be any suitable configuration including a flashing light or a strobe light. In some embodiments, the beacon light 20 may include a protective cover 20A made of a high impact polymer such as a plastic resin. Further, the protective cover 20A or the beacon light 20 may be colored so as to emit a red or orange light. In preferred embodiments, the output of the beacon light 20 is controlled such that the beacon does not interfere with the vision of the workman working in the vicinity of the ball 3. This may be done by using a colored protective cover. In one exemplary embodiment, the light output is similar to a battery operated road-side flasher.

The audible warning device 22 may be variously configured to include any audible warning signal such as the audible warning signal commonly associated with backing movement of a trunk. It may be desirable to maintain the volume of the audible sensor within a range which alerts the workman in the vicinity of the ball to movement of the ball but without interfering with normal communications of the workman. In other words, the workman should still be able to speak over the audible warning noise. To facilitate this objective, the beeping noise emitted by the audible warning device may be limited to occur at a rate of only once per second, or ever other second or every third second. Alternatively, the audible warning noise may be emitted continuously at a particular frequency. The audible warning device 22 may be used in addition to or instead of the beacon light 20.

The local and/or remote sensors/camera devices 12, 13 may be variously configured. For example, the sensors may include nay one of a number of local sensors or remote sensors. In one embodiment, one or more local acceleration sensors are included which detect acceleration of the ball 3 in any one of three dimensions. For example, a vertically and horizontally mounted acceleration sensor may be utilized. The acceleration detector may be any detector known in the art such as a piezoelectric sensor and/or a mercury based sensor. Of these, the piezoelectric based sensor may be more desirable due to the high impact environment often experienced by the ball 3. Further, one or more laser range finder may be incorporated into the remote sensors/camera devices 12, 13. For example, a first laser range finder may be trained on and/or located within the ball to determine the distance of the ball from the boom. A second laser range finder may be located on the boom and/or carriage and used to determine the distance from the boom to the ground or target location where the ball is suppose to be positioned above. The first laser range finder may be utilized by the central control device to determine the rate of acceleration of the ball toward the target such that the ball may be accelerated relatively quickly while it is a great distance from the target and then slow as it approaches the target. In this manner, the overall efficiency of the crane operation may be improved without a decrease in safety.

There are any number of degrees of freedom for the ball of a crane to move. The ball may move at a constant velocity with no acceleration or with a variable or constant acceleration. For example, the ball may move along the boom on a carriage, or the ball may move as a telescoping boom extends or retracts. The ball may also move as the boom swings right or left or moves up or down. In other words, a ball on a typical crane is capable of total three dimensional movement with either a constant velocity and no acceleration or a variable velocity with acceleration. Thus, an acceleration detector alone will not reliably detect when a crane is in motion. Accordingly, a local motion detector may be included in each of the crane warning devices which uses any suitable technique to detect motion. For example, an ultrasonic and/or laser ranging system similar to those employed to focus cameras and/or for target acquisition may be utilized. In one exemplary embodiment, one or more ultrasonic/laser ranging sensors may be mounted to detect the ball's relative distance from the boom 5, target, and/or cab 7. For example, one or more first sensors may be directed towards the boom, and one or more second sensors may be directed toward the cab or out-riggers 8 or target. Further, a plurality of sensors may be located on multiple sides of the ball in the event that the ball twists. In exemplary embodiments, it may be desirable to have two, three, or more motion sensors disposed at spaced locations such that the position of the ball 3 and movement of the ball 3 may be determined at any time via well known triangulation methods. Any number of motion sensors and/or acceleration sensors may be included in the crane warning devices (e.g., mounted entirely within the ball) and/or distributed at various locations about the crane 2 and configured to be in electrical and/or electromagnetic communication with the crane warning devices and/or central control device.

Where remote sensors are utilized, the remote sensors may be coupled to the crane's movement mechanism 6 and/or the crane's electronic control system 47. For example, each time that the crane's hydraulic system 51 is actuated a signal may be sent from any one of a number of remote sensors 42A–42E to the crane warning devices 4 (either directly or via the central control device 11) activating a warning. Each of the crane warning devices need not be actuated by the same signals/sensors. For example, the crane warning devices 4A, 4C proximate to the ball may be activated whenever cable movement is detected to raise, lower, or swing the cable/boom, whereas the crane warning devices 4*b* proximate to the counter weight 10 may only be activated when the operator initiated a swinging action of the cab such that the counter weight swung left or right. In other words, where multiple crane warning devices are affixed to the crane, each warning device may be under separate control and responsive to some separate sensors and/or some common sensors. Further, the crane warning devices may receive control locally, from the central control device 11, and/or from one or more remote sensors including the camera 13. Similarly, the sensors 12, 13 may send signals to the central control device 11 such that the central control device may control the accent and/or decent of the ball and/or the crane warning devices responsive to the sensors 12, 13.

The crane warning devices 4 may be synchronized such that the audible and/or visual warnings emitted from the devices occur in unison. This eliminates much of the noise distortion of many warning devices occurring at the same time but skewed from each other or operating at a different frequency. Further, the audible warning emitted from the warning device may change depending on the motion of the crane. For example, where the ball is moving up, a first audio frequency would be emitted; where the ball is moving down, a second audio frequency would be emitted; where the crane is turning left or right, a third audio frequency is emitted, etc.

In this manner, regardless of the indication given by the crane operator, the workers would know what motion to expect out of the crane based solely on the noise emitted by the warning device. Additionally, it may be desirable to delay movement of the crane for a relatively short period of time (e.g., one, two, or three seconds) while the audible tone sounds. This allows the workers to have, for example, a fraction of a second notice, before movement of the ball actually takes place.

The local—remote sensors may also include one or more cameras 13. One or more cameras 13 may be mounted directly in the crane warning device 4 using, for example, one or more digitally corrected/concatenated wide angle lens, and/or a camera mounted on the boom/carriage to obtain a birds eye view of the workers and ball. For the wide angle lenses, digital correction techniques and techniques to concatenate the various image views (e.g., to form a 360 degree view) are well know in the art. Where the cameras are mounted on the carriage an/or boom, a manual, fixed, and/or automatic zoom feature may be utilized to improve the visual indication provided to the operator. The visual indication provides the operator with additional information as to the position of the load, ball and workers. Where the camera is mounted on the boom, the camera 13 may include a fixed and/or adjustable zoom control which enables the operator to view the work up-close. Where the zoom of the camera in under operator control the control may be via one or more remote switches located in the cab such as on control interface 48. The display from the camera 13 may be shown on display 43. The display 43 may be further located close to the line of view of the operator out the window in the cab 7 such that the operator may watch the display while still being able to watch the ball and associated payload out the window. Where more than one remote camera 13 is located about the crane, the display 43 may be subdivided into different windows each showing a different camera angle and/or different displays.

The recharging interface 36 operates to recharge the batteries in the cable warning devices 4 periodically. In some embodiments, the cable warning devices incorporate lithium ion batteries which have a high charge density. One or more retractable recharge cables may be coupled from the main body of the crane to the cable warning devices 4 on a periodic basis to recharge the batteries. Alternatively, the batteries may be manually replaceable with or without an option to plug the replaced batteries into a recharging station on the crane body. In the event of a low battery condition, the crane operator will be warned that the battery 23 in one or more of the crane warning devices 4 is low and needs to be recharged and/or replaced. The indication may occur on the display 43.

The audio processor 23 in the crane warning devices allows the operator to communicate with the workers. Where a microphone and speaker system is included in the warning devices, the operator can communicate with the workers manipulating the ball 3. Conventionally, a worker manipulating the ball must signal the operator visually with one hand. Modern cranes have the operator enclosed in a environmentally controlled enclosure making voice communication impractical. Accordingly, by including a sophisticated audio processor (e.g., and advanced two-way baby monitor/speaker phone) within the warning devices (such as the one in the ball or on the counter weight), one located on one or more workers (e.g., a two way radio) and one within the cabin 7, the crane operator may have two way communication with the workers. In this manner, worker safety is vastly increased because the worker may use both hands to manipulate the load while verbally signaling the operator. Where the communication device is located in the ball, the communication device also improves over radio communications since neither the operator or the workman have to carry or wear a radio. Further, the speaker and microphone are always present in the ball further improving safety where, for example, a worker forgets his radio and/or the radio is not working due to low battery power. Further, by building the audible device into the ball of the crane, the workers do not have to utilize one hand to operate hand-held radios or other communication devices. Where both a camera and an audio processor are utilized, the combination of theses devices taken together, vastly increases safety and efficiency of the crane operating environment over either device used individually.

The audio processor may be further configured to electronically filter the noise from the crane's audible warning device so as not to interfere with normal communication with the crane operator. This electronic filtering is done to filter out the beeping or tones emitted from the warning device without filtering out the normal voice of the operator and/or worker. Where the beeping noise occurs at a predetermined frequency, an electronic filter in the audio processor may be utilized to eliminate or severely attenuate the warning noise such that the operator can easily communicate with the workers. The verbal communication to each of the warning devices further enhances safety in that the operator has immediate communications with all sides of the crane. For example, where another worker notices a safety concern, he can communicate with the operator using any one of the cable warning devices 4.

Communications between the various motion sensors, warning devices 4, and/or central control device 11 may be accomplished using any suitable mechanism such as transmitter/receiver devices 24, 49. For example, the devices may communicate using electromagnetic waves such as radio waves. In some embodiments, a radio frequency in the range of about 900 MHz may be utilized to communicate between the warning device coupled to the ball and the warning device coupled to other portions of the crane. Suitable error correction codes, loss of signal detection, and channel hopping may be incorporated into the transmitter/receiver devices 24,49 to increase safety and reliability. In the event of loss of communications, the warning devices 4 and/or central control device may be programmed to sound an alarm. In still further aspects of the crane warning system 1, fail-safe mechanisms may be built into the crane warning device such that the warning device is activated whenever a sensor fails or loses contact (e.g., radio contact) with the warning device. Further, a crane warning device status monitor may be built into the cabin of the crane so that the operator may be warned of any operational problems with any of the sensors in a timely fashion. Further, the operator may be able to determine and/or select a particular microphone/speaker to which to communicate.

In addition to the above, the camera feed may be sent from the camera(s) 13 and/or central control device 11 to two or more locations. For example, the camera feed may be sent to a monitor mounted in the site supervisor's and/or foreman's trailer. Further, the remote feed may be transmitted via a telephone link and/or other link to a remote office such as the construction companies headquarters such that the main company may track the progress of each of its construction projects in real time. In this manner, the site supervisor and/or foreman may be able to monitor the activities of the site to determine work progress and/or worker activity and be alerted to potential safety problems immediately. Further, the central office may be able to centralize ordering and scheduling activities from the main office without having to distribute staff to each of the individual work sites.

Figure 9:
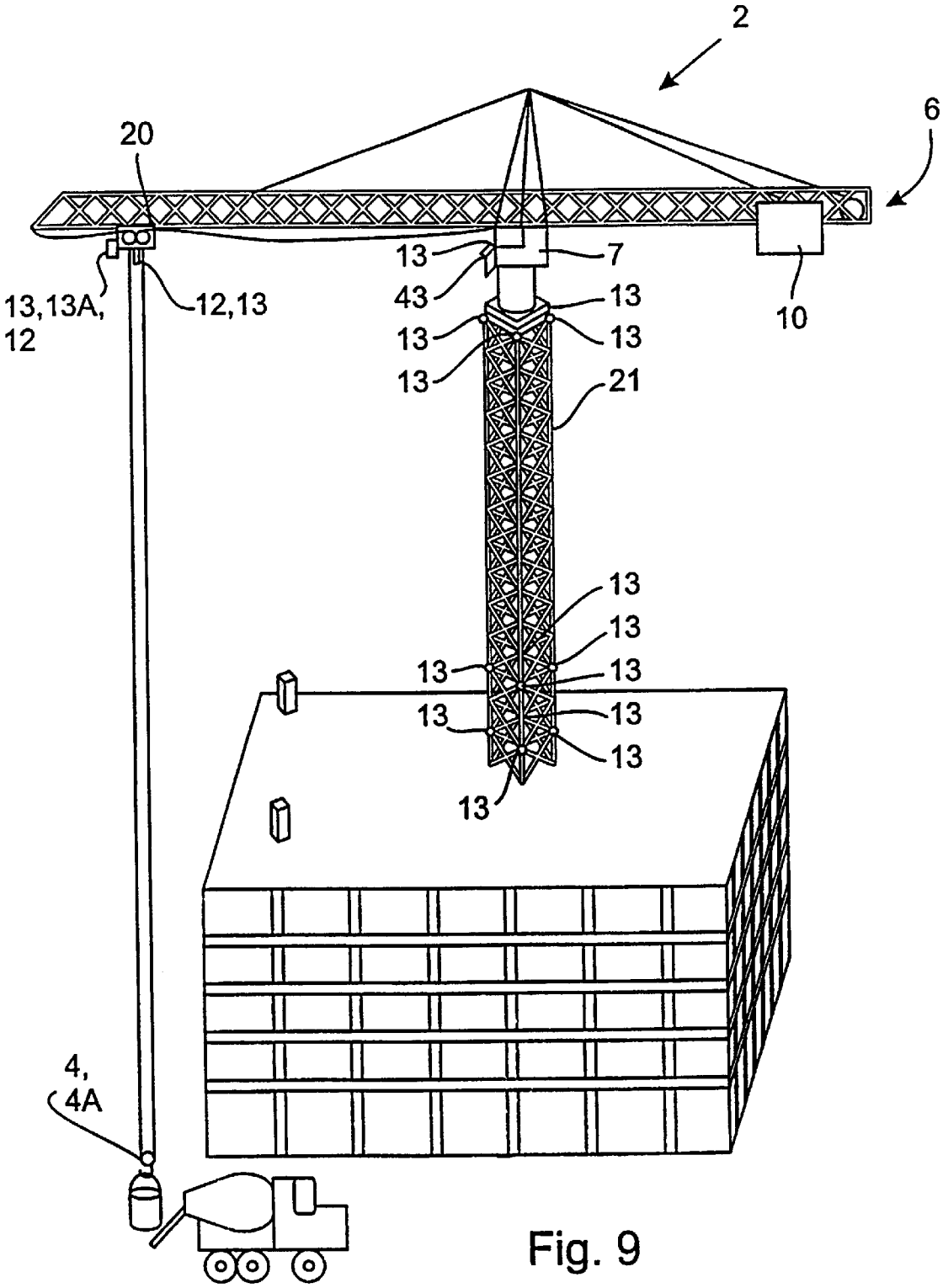
FIG. 9 is a perspective view of second embodiment of a crane incorporating aspects of the invention.

A second exemplary embodiment of he invention is shown in FIG. 9. As shown in FIG. 9, the crane 2 may be a crane commonly utilized to construct tall buildings. The camera may be mounted on the carriage 20. Further, the cameras and/or sensors 12, 13, 13A may also be mounted on the carriage. Additional cameras may be mounted on other locations of the crane such as the cab 7. The camera mounted on the cab 7 may be configured to track the ball knowing the location of the carriage 20 (using, for example a laser range finder mounted to the carriage and directed toward the cabin, and/or on the cabin and directed towards the carriage) and the location of the ball using a second range finder located on the ball and/or on the carriage 20). In this manner, the camera may be automatically moved track the current location of the ball and zoom in on the work area.

Further, the mounting of the camera on the carriage allows the operator to see around blind ends of the building as the building is constructed such that the crane operator may see areas which would otherwise be obstructed. In this manner, the overall speed, efficiency, and safety of the crane operation is improved. Cameras are known in automated manufacturing environments where cranes are also utilized to transport various components along the manufacturing line. However, the use of remotely mounted cameras on the boom, cradle, and/or ball of a cantilever type crane has not heretofore been done, particularly in the construction industry. In the construction industry, there is a high incidence of accidents due to common obstructions which block the view of the crane operator and conditions (e.g., surrounding buildings and location of shafts within the building) which prevent the operator in the cab from being able to adequately see and access the area around the ball. Further, for very tall buildings, the cranes are often many stories above the work area. Thus, there is a substantial need to address these safety concerns by providing cameras having appropriate angles and mounting locations (particularly as positioned on the boom, cradle, or ball or a cantilevered construction crane) to ensure safe operation. The cameras are particularly applicable to construction cranes with cantilevered horizontal booms which extend for 100 feet or more since it is difficult for the operator to see over and around obstructions which typically occur in this environment. Additionally, cameras in accordance with aspects of the invention are particularly applicable to cantilevered booms extending 100 feet or more which are positioned on the ground and utilized to place construction materials or other items used in construction on locations above where a building is being constructed.

As an alternative embodiment, a communication bus such as an Ethernet, fire wire, and/or fiber optic communication path may be disposed along the tower, and/or from the boom to the cab in order to facilitate communications from the various sensor/cameras, the cab, and/or any remote sites (e.g., a trailer).

While an exemplary crane warning devices embodying one or more aspects of the present invention are shown, it will be understood, of course, that the invention is not limited to these embodiments. Modifications may be made by those skilled in the art, particularly in light of the foregoing teachings. It is, therefore, intended that the appended claims cover any such modifications which incorporate the features of this invention or encompass the true spirit and scope of the invention. For example, each of the elements and/or steps of the aforementioned embodiments may be utilized alone or in combination with other elements and/or steps from other embodiments. For example, it is specifically contemplated by the inventor that any one of the following may be claimed either alone or in combination with one or more of the other elements below:

1. Camera mounted on carriage;
2. Camera mounted on ball;
3. One or more cameras mounted on cab;
4. One or more cameras mounted on a cantilevered boom of a construction crane;
5. One or more cameras mounted on tower;
6. One or more cameras mounted on counterweight;
7. One or more cameras mounted about the cab (e.g., in a 360 degree view);
8. One or more cameras mounted about the tower (e.g., in a 360 degree view);
9. One or more cameras mounted about the tower (e.g., in a 360 degree view) in multiple vertical locations showing a 360 degree horizontal view (about 90 degrees per camera);
10. Zoom camera mounted on any of the above;
11. Manually controlled zoom camera mounted on any of the above with controls located in the cab;
12. Automatically controlled zoom camera mounted on any of the above;
13. Wide angle camera mounted on any of above;
14. Camera mounted on any of the above with display in the cab;
15. Camera mounted on at least two of the above locations with multiple displays in the cab;
16. Camera permanently mounted on at least two of the above with multiple display windows on a single display in the cab;
17. Camera mounted on any of the above with the feed going to a display located in a remote location such as a trailer;
18. One or more cameras mounted on any of the above with a feed going to a display located at a remote location such as the construction company's headquarters;
19. Sensor (e.g, range finder) mounted on carriage, cab, tower, ball, boom and/or cable;
20. Sensor readings displayed in cab;
21. Sensor readings used to control assent and/or descent of ball;
22. Sensor readings used to increase acceleration and/or deceleration while ball is not close to target or boom;
23. Sensor used to determine zoom of camera and/or manual zoom of camera controlled by operator;
24. Sensor used to determine where the camera is controlled to point;
25. Sensor used to determine a relative distance between the ball and target (e.g. floor or ground location);
26. Sensor used to determine when the warning device is to be activated responsive to movement of the ball;
27. Acceleration sensor used to determine activation of warning device;
28. Motion sensor used to determine activation of warning device;
29. Hydraulic sensor used to determine activation of warning device;
30. Sensor coupled to warning device via electromagnetic waves;
31. Sensor coupled to control system of crane;
32. Crane warning device coupled to central control device via electromagnetic waves;
33. Warning device emitting a modified signal based on sensor output;
34. Warning device emitting a different signal on assent than on decent;

35. A crane ball including a crane warning device;
36. A crane ball including a flashing and/or strobe light;
37. A crane ball including an audible beeper;
38. A crane warning device visible from all sides;
39. Display of camera feed located about cab;
40. Display of camera feed located in a line of sight where the operator can see both the display and the ball out the window of the cab;
41. A plurality of camera displays located about the cab;
42. A plurality of camera images being displayed on a single display in windows;
43. Display of the camera feed in a remote location such as in the site foreman's or site supervisor'cabin;
44. Display of the camera feed in both a remote location and in the cab;
45. Speech processor located in the ball;
46. Speech processor located about cable above ball;
47. Microphone located in the ball;
48. Microphone located about cable above ball;
49. Speaker phone located in ball and communicating with cab;
50. Speaker phone being located on a workmen working in vicinity of ball and communicating with cab;
51. Speaker phone located in vicinity of ball having a digital filter to filter out noise of warning device;
52. Microphone and speaker being mounted in cab and in ball allowing two way communication between cab and workers in the vicinity of the ball;
53. A crane having a plurality of distributed crane warning devices;
54. A plurality of distributed crane warning devices emitting a beeping noise while the crane is in motion;
55. A plurality of distributed crane warning devices, each being coupled to a different sensor to emit a warning signal responsive to different events (e.g., movement of ball, movement of counter weight);
56. A plurality of crane warning devices emitting a synchronized warning signal;
57. A crane warning device including a microphone and speaker;
58. A crane warning device include a camera;
59. A plurality of crane warning devices communicating with a central control device;
60. A crane comprising a crane, boom, and ball, with a camera mounted on the boom directed at the ball;
61. A crane comprising a crane, boom, carriage, and ball, with a camera mounted on the carriage facing the ball;
62. A crane having an warning device mounted on a counter weight;
63. Varying a signal emitted by an electronic warning indicator responsive to the type of motion being initiated by a crane ball;
64. Emitting a signal from an electronic warning indicator just prior to actually initiating the movement;
65. A method comprising having two crane warning device communicating with each other;
66. A method comprising employing a plurality of remotely mounted crane ball movement warning sensors communicating with a central control device;
67. Locating an antenna within an open enclosure of a crane ball;
68. Locating a light within an open enclosure of a crane ball;
69. A light with a colored protective cover within an open enclosure of a crane ball;
70. Locating a flashing light within a open enclosure of a crane ball;
71. Locating multiple speakers (e.g., each facing a different direction) within a crane ball;
72. Locating a crane warning device such that it surrounds a cable in a location proximate to a ball of a crane;
73. Disposing batteries within a ball of a crane;
74. Disposing a removable battery pack within a ball of a crane;
75. Disposing batteries with a recharging interface in a ball of a crane;
76. Locating a battery recharging station on a crane;
77. Locating a battery in a crane warning device;
78. Disposing a communication link along the tower (e.g., an Ethernet connection);
79. Disposing a communication link along the boom (e.g., an Ethernet connection);
80. Using a communication link to communicate between the cab and a remote sensor and/or camera;
81. Using a communication link to communicate between the cab (e.g., central control device) and a remote site such as a trailer and/or a central office;
82. Disposing failure mode detectors within the warning devices to give the crane operator an indication when one or more of the crane warning devices is inoperable;
83. Having a test loop where the speaker emits a predetermined tone which is thereafter detected by the microphone in the crane warning device to have a periodic self test;
84. Output of sensor shown over display in cab as an overlay;
85. A ball with an open enclosure;
86. A ball with an open enclosure having a camera disposed therein;
87. A signal processing device including an electronic filter for reducing the level of beeps heard by an operator in a cab relative to voice input to a microphone in a ball;
88. Display in the cab (e.g., an overlay on display) showing distance to target or floor, distance of ball from floor or boom, distance of carriage from cab along boom;
89. A central control device including a memory, a controller, and a signal processor located in an arrangement supported by the tower and controlling any of the above;
90. A central control device including an antenna for remotely communicating with at least one crane warning device;
91. Mounting a range finder (e.g., a laser range finder) on a ball of a crane;
92. Mounting a range finder (e.g., a laser range finder) on a cab of a crane;
93. Mounting a range finder (e.g., a laser range finder) on a carriage of a crane;
94. Mounting a range finder (e.g., a laser range finder) on a carriage of a crane pointing at the ball;
95. Mounting a range finder (e.g., a laser range finder) on a carriage of a crane pointing at a target (floor) which lies below the ball and any associated payload;
96. Mounting a range finder (e.g., a laser range finder) on a boom of a crane;
97. Mounting a sensor on hydraulics of a crane to detect motion;
98. Coupling a sensor to a movement mechanism of a crane to detect motion;
99. Using a laser range finder on a crane;
100. Using an acceleration detector on a crane.

Additionally, one or more of the above elements may be combined with another element, method, or technique shown in the drawings or described in the specification. For example, one or more of the above elements may be utilized on a cantilevered construction crane having a boom length of at least 80 feet and even more desirable for those cantilevered construction cranes having a total boom length in excess of 100 feet.

I claim:

1. A crane warning system, comprising:

a crane warning device for producing a perceptible warning signal; and a sensor coupled to an electro-mechanical component for moving the ball of the crane, such that the senor detects when the electro-mechanical component is actuated to move the ball of the crane, and activates the perceptible warning signal in response to detecting when the electro-mechanical component is actuated to move the ball of the crane.

2. The craning warning system of claim 1 wherein the sensor is coupled to a hydraulic system of the crane used to move the crane ball.

3. The craning warning system of claim 1 wherein the sensor is coupled to an electronic control system of the crane that controls movement of the crane ball.

4. The crane warning device of claim 1, wherein the sensor is further configured to detect a constant velocity of the ball.

5. A crane warning system, comprising:

a crane warning device for producing a perceptible warning signal; and a sensor coupled to an electro-mechanical component for moving the ball of the crane, such that the sensor detects when the electro-mechanical component is actuated to move the ball of the crane, and activates the perceptible warning signal in response to detecting when the electro-mechanical component is actuated to move the ball of the crane, wherein the sensor activates the perceptible warning signal by wirelessly transmitting an electromagnetic signal to the crane warning device.

6. The crane warning system of claim 1, further comprising a crane warning device status monitor positioned in a cabin of the crane.

7. The crane warning system of claim 1, wherein the crane warning device includes a beacon light for producing a visible perceptible warning signal.

8. The crane warning system of claim 1, wherein the crane warning device includes a speaker for producing an audible perceptible warning signal.

9. The crane warning system of claim 1, wherein the crane warning device further includes a beacon light for producing a visible perceptible warning signal.

10. The crane warning system of claim 1, wherein the crane warning device is positioned on a ball of the crane or on a counterweight of the crane.

11. The crane warning system of claim 10, wherein the crane warning device is integrally formed with the ball of the crane.

12. The crane warning system of claim 10, wherein the crane warning device is removably mounted on the ball of the crane.

13. The crane warning system of claim 1, wherein the sensor further detects a direction of motion of the ball of the crane; and the crane warning device produces a first perceptible warning signal in response to the sensor detecting motion of the ball of the crane in a first direction, and produces a second perceptible warning signal different from the first perceptible warning signal in response to the sensor detecting motion of the ball of the crane in a second direction.

14. The crane warning system of claim 1, further comprising:

a second crane warning device for producing a second perceptible warning signal.

15. The crane warning system of claim 14, wherein the second warning device produces the second perceptible warning signal in response to the sensor detecting motion of the ball of the crane.

16. The crane warning system of claim 15, further comprising:

a second sensor coupled to a second electro-mechanical component for moving the ball of the crane, such that the sensor detects when the second electro-mechanical component is actuated to move the ball of the crane, and activates the perceptible warning signal of the second warning device in response to detecting when the second electro-mechanical component is actuated to move the ball of the crane.

17. The crane warning system of claim 16, wherein the first sensor detects actuation of the first electro-mechanical component of the crane to move a boom of the crane or to move a cable supporting the ball of the crane;

the first crane warning device is positioned on a ball of the crane;

the second sensor detects actuation of the second electro-mechanical component of the crane to move a cab of the crane; and the second crane warning device is positioned on a counterweight of the crane.

18. A crane warning system, comprising:

a crane warning device for producing a perceptible warning signal; and one or more ultrasonic or laser ranging sensors positioned to detect movement of the ball of the crane, such that the one or more sensors detects when the ball of the crane is moving, and activates the perceptible warning signal of the crane warning device in response to detecting movement of the ball of the crane.

19. The crane warning system of claim 18, further comprising a plurality of ultrasonic or laser ranging sensors configured for detecting motion of the ball of the crane, such that the sensors can determine a position of the ball of the crane via triangulation.

20. The crane warning system of claim 18, wherein the one or more ultrasonic or laser ranging sensors activate the perceptible warning signal by wirelessly transmitting an electromagnetic signal to the crane warning device.

21. The crane warning system of claim 18, further comprising a crane warning device status monitor positioned in a cabin of the crane.

22. The crane warning system of claim 18, wherein the crane warning device includes a beacon light for producing a visible perceptible signal.

23. The crane warning system of claim 18, wherein the crane warning device includes a speaker for producing an audible perceptible signal.

24. The crane warning system of claim 23, wherein the crane warning device includes a beacon light for producing a visible perceptible signal.

25. The crane warning system of claim 18, wherein the warning device is positioned on a ball of the crane or on a counterweight of the crane.

26. The crane warning system of claim 25, wherein the crane warning device is integrally formed with the ball of the crane.

27. The crane warning system of claim 25, wherein the crane warning device is removably mounted on the ball of the crane.

28. The crane warning system of claim 18, wherein the one or more ultrasonic or laser ranging sensors further detect a direction of motion of the ball of the crane; and the crane warning device produces a first perceptible warning signal in response to the one or more ultrasonic or laser ranging sensors detecting motion of the ball of the crane in a first direction, and produces a second perceptible warning signal different from the first perceptible warning signal in response to the sensor detecting motion of the ball of the crane in a second direction.

29. The crane warning system of claim 18, further comprising:

a second crane warning device for producing a second perceptible warning signal.

30. The crane warning system of claim 29, wherein the second warning device produces the second perceptible warning signal in response to the one or more ultrasonic or laser ranging sensors detecting motion of the ball of the crane.

31. A crane warning device, comprising:

a casing configured for attachment to a crane;

a receiver for receiving an electromagnetic signal indicating that an electro-mechanical component of a crane has been actuated to move a ball of the crane, the receiver being contained within the casing; and a warning signal generator for generating a perceptible warning signal in response to the receiver receiving the electromagnetic signal indicating that an electro-mechanical component of the crane has been actuated to move the ball of the crane, the warning signal generator being contained within the casing.

32. The crane warning device of claim 31, further comprising a crane warning device status monitor positioned in a cabin of the crane.

33. The crane warning device of claim 31, wherein the warning signal generator includes a beacon light for producing a visible perceptible warning signal.

34. The crane warning device of claim 31, wherein the warning signal generator includes a speaker for producing an audible perceptible warning signal.

35. The crane warning device of claim 34, wherein the warning signal generator further includes a beacon light for producing a visible perceptible warning signal.

36. The crane warning device of claim 31, wherein the casing is positioned on a ball of the crane or on a counterweight of the crane.

37. The crane warning device of claim 36, wherein the casing is integrally formed with the ball of the crane.

38. The crane warning device of claim 36, wherein the casing is removably mounted on the ball of the crane.

39. The crane warning device of claim 31, wherein the electromagnetic signal further indicates a direction of motion of the ball of the crane; and the warning signal generator produces a first perceptible warning signal in response to the electromagnetic signal indicating motion of the ball of the crane in a first direction, and produces a second perceptible warning signal different from the first perceptible warning signal in response to the electromagnetic signal indicating motion of the ball of the crane in a second direction.

40. A crane warning device, comprising:

a casing configured for attachment to a crane;

a receiver for receiving an electromagnetic signal indicating that an electro-mechanical component of a crane has been actuated to move a ball of the crane, the receiver being contained within the casing; and a warning signal generator for generating a perceptible warning signal in response to the receiver receiving the electromagnetic signal indicating that an electro-mechanical component of the crane has been actuated to move the ball of the crane, the warning signal generator being contained within the casing, wherein the receiver receives a wireless electromagnetic signal indicating that an electro-mechanical component of a crane has been actuated to move a ball of the crane.

41. A crane, comprising:

a ball, an electro-mechanical system for moving the ball;

a sensor coupled to the electro-mechanical system for producing an activation signal when the electro-mechanical system is activated to move the ball; and a crane warning device for producing a perceptible warning signal in response to the sensor producing the activation signal.

42. The crane of claim 41, wherein the electro-mechanical system is a hydraulic system.

43. The crane of claim 41, wherein the electro-mechanical system is an electronic control system.

44. The crane of claim 41, wherein the sensor activates the perceptible warning signal by wirelessly transmitting an electromagnetic signal to the crane warning device.

45. The crane of claim 41, further comprising a crane warning device status monitor positioned in a cabin of the crane.

46. The crane of claim 41, wherein the crane warning device includes a beacon light for producing a visible perceptible warning signal.

47. The crane of claim 41, wherein the crane warning device includes a speaker for producing an audible perceptible warning signal.

48. The crane of claim 47, wherein the crane warning device further includes a beacon light for producing a visible perceptible warning signal.

49. The crane of claim 41, wherein the warning device is positioned on the ball of the crane or on a counterweight of the crane.

50. The crane of claim 49, wherein the crane warning device is integrally formed with the ball of the crane.

51. The crane of claim 49, wherein the crane warning device is removably mounted on the ball of the crane.

52. The crane of claim 41, wherein the sensor further detects a direction of motion of the ball of the crane; and the crane warning device produces a first perceptible warning signal in response to the sensor detecting motion of the ball of the crane in a direction, and produces a second perceptible warning signal different from the first perceptible warning signal in response to the sensor detecting motion of the ball of the crane in a second position.

53. The crane of claim 41, further comprising a second crane warning device for producing a second perceptible warning signal.

54. The crane of claim 53, wherein the second crane warning device produces the second perceptible warning signal in response to the sensor detecting motion of the ball of the crane.

55. The crane of claim 54, further comprising a second sensor coupled to the electro-mechanical system, such that the sensor detects when the electro-mechanical system is actuated to move the ball of the crane, and activates the perceptible warning signal of the second crane warning device in response to detecting when the electro-mechanical system is actuated to move the ball of the crane.

56. The crane of claim 55, wherein the first sensor detects actuation of the electro-mechanical system to move a boom of the crane or to move a cable supporting the ball of the crane;

the first crane warning device is positioned on the ball of the crane;

the second sensor detects actuation of the electro-mechanical system to move a cab of the crane; and the second crane warning device is positioned on a counterweight of the crane.

57. A crane warning system, comprising:

a plurality of sensors, each sensor being coupled to a different component of a hydraulic system of a crane and producing an activation signal when the coupled component of the hydraulic system is actuated to move a ball of the crane; and a crane warning device for producing a perceptible warning signal in response to one of the plurality of sensors producing an activation signal.

58. The crane warning system of claim 57, wherein at least one of the plurality of sensors wirelessly transmits the activation signal to the crane warning device.

59. A crane warning system, comprising:

a plurality of sensors, each sensor being coupled to a different component of a hydraulic system of a crane and producing an activation signal when the coupled component of the hydraulic system is actuated to move a ball of the crane; and a crane warning device for producing a perceptible warning signal in response to one of the plurality of sensors producing an activation signal, wherein at least one of the plurality of sensors wirelessly transmits the activation signal to the crane warning device.

60. A crane warning system, comprising:

a plurality of sensors, each sensor being coupled to a different component of a hydraulic system of a crane and producing an activation signal when the coupled component of the hydraulic system is actuated to move a ball of the crane;

a crane warning device for producing a perceptible warning signal in response to one of the plurality of sensors producing an activation signal; and a crane warning device status monitor positioned in a cabin of the crane.

61. The crane warning system of claim 57, wherein the crane warning device includes a speaker for producing an audible perceptible warning signal.

62. The crane warning system of claim 61, wherein the crane warning device further includes a beacon light for producing a visible perceptible warning signal.

63. The crane warning system of claim 62, wherein the crane warning device further includes a beacon light for producing a visible perceptible warning signal.

64. The crane warning system of claim 63, wherein the crane warning device is integrally formed with the ball of the crane.

65. The crane warning system of claim 63, wherein the crane warning device is removably mounted on the ball of the crane.

66. The crane warning system of claim 57, wherein at least one of the plurality of sensors further detects a direction of motion of the ball of the crane; and the crane warning device produces a first perceptible warning signal in response to the at least one of the plurality of sensors detecting motion of the ball in a first direction, and produces a second perceptible warning signal different from the first perceptible warning signal in response to the at least one of the plurality of sensors detecting motion of the ball in a second direction.

67. A crane warning system, comprising:

a plurality of sensors, each sensor being coupled to a different component of a hydraulic system of a crane and producing an activation signal when the coupled component of the hydraulic system is actuated to move a ball of the crane; and a crane warning device for producing a perceptible warning signal in response to one of the plurality of sensors producing an activation signal, wherein at least one of the plurality of sensors further detects a direction of motion of the ball of the crane; and the crane warning device produces a first perceptible warning signal in response to the at least one of the plurality of sensors detecting motion of the ball in a first direction, and produces a second perceptible warning signal different from the first perceptible warning signal in response to the at least one of the plurality of sensors detecting motion of the ball in a second direction.

68. The crane warning system of claim 67, wherein the second crane warning device produces the second perceptible warning signal in response to at least one of the plurality of sensors detecting motion of the ball of the crane.

69. The crane warning system of claim 68, wherein a first sensor of the plurality of sensors detects actuation of the hydraulic system to move a boom of the crane or to move a cable supporting a ball of the crane;

the first crane warning device is positioned on a ball of the crane;

a second sensor of the plurality of sensors detects actuation of the hydraulic system to move a cable of the crane; and the second crane warning device is positioned on a counterweight of the crane.

70. A crane warning system, comprising:

one or more sensors, each sensor being coupled to an electro-mechanical component for moving a ball of the crane, such that each of the one or more sensors detects when the coupled electro-mechanical component is actuated to move the ball of the crane, and generates an activation signal when the coupled electro-mechanical component is actuated to move the ball of the crane;

one or more crane warning devices that generate a perceptible warning signal; and a central control device that activates the one or more warning devices to generate the perceptible warning signal in response to receiving an activation signal from the one or more sensors.

71. The crane warning system of claim 70, wherein at least one of the one or more sensors is coupled to a hydraulic system used to move the crane ball.

72. The crane warning system of claim 70, wherein at least one of the one or more sensors is coupled to an electronic control system that controls movement of the crane ball.

73. The crane warning system of claim 70, further comprising a crane warning device status monitor positioned in a cabin of the crane.

74. The crane warning system of claim 70, wherein at least one of the one or more crane warning devices includes a beacon light for producing a visible perceptible warning signal.

75. The crane warning system of claim 70, wherein at least one of the one or more crane warning devices includes a speaker for producing an audible perceptible warning signal.

76. The crane warning system of claim 75, wherein the at least one of the one or more crane warning devices further includes a beacon light for producing a visible perceptible warning signal.

77. The crane warning system of claim 70, wherein at least one of the one or more crane warning devices is positioned on a ball of the crane or on a counterweight of the crane.

78. The crane warning system of claim 77, wherein the at least one of the one or more crane warning devices is integrally formed with a ball of the crane.

79. The crane warning system of claim 77, wherein the at least one of the one or more crane warning devices is removably mounted on a ball of the crane.

80. The crane warning system of claim 70, wherein at least one of the one or more sensors further detects a direction of motion of he ball of the crane; and at least one of the one or more crane warning devices produces a first perceptible signal in response to the at least one of the one or more sensors detecting motion of the ball in a first direction, and produces a second perceptible signal different from the first perceptible warning signal in response to the at least one of the one or more sensors detecting motion of the ball in a second direction.

81. The crane warning system of claim 70, wherein a first sensor of the one or more sensors detects actuation of the coupled electro-mechanical component to move a boom of the crane or to move a cable supporting the ball of the crane; and a first crane warning device of the one or more crane warning devices produces a first perceptible warning signal in response to the first sensor detecting motion of a boom of the crane or motion of a cable supporting the ball of the crane, and is positioned on a ball of the crane;

a second sensor of the one or more sensors detects actuation of the coupled electro-mechanical component to move a cab of the crane; and a second crane warning device of the one or more crane warning devices produces a second perceptible warning signal in response to the second sensor detecting motion of a cab of the crane, and is positioned on a counterweight of the crane.

82. The crane warning system of claim 71, wherein a first sensor of the one or more sensors detects actuation of the coupled electro-mechanical component to move a boom of the crane or to move a cable supporting the ball of the crane; and a first crane warning device of the one or more crane warning devices produces a first perceptible warning signal in response to the first sensor detecting motion of a boom of the crane or motion of a cable supporting the ball of the crane, and is positioned on a ball of the crane;

a second sensor of the one or more sensors detects actuation of the coupled electro-mechanical component to move a cab of the crane; and a second crane warning device of the one or more crane warning devices.

83. The method of claim 82, wherein the electromechanical component is a hydraulic system of the crane used to move the crane ball.

84. The method of claim 82, wherein the electromechanical component is an electronic control system of the crane that controls movement of the crane ball.

85. The method of claim 82, further including wirelessly transmitting the activation signal.

86. The method of claim 82, further comprising, in response to generating the activation signal, activating a crane warning device status monitor positioned in a cable of the crane.

87. The method of claim 82, further comprising generating a visual perceptible warning signal.

88. The method of claim 82, further comprising generating an audible perceptible warning signal.

89. The method of claim 88, further comprising generating a visual perceptible warning signal.

90. The method of claim 88, further wherein the activation signal indicates the direction of movement of the ball of the crane; and further comprising generating a first perceptible warning signal if the activation signal indicates movement of the ball of the crane in a first direction; and generating a second perceptible warning signal different from the first perceptible warning signal if the activation signal indicates movement of the ball of the crane in a second direction.

91. The method of claim 82, further comprising:

detecting a direction of movement of the ball of the crane;

generating an activation signal indicating the direction of movement of the ball of the crane;

generating a first perceptible warning signal if the activation signal indicates movement of the ball of the crane in a first direction; and generating a second perceptible warning signal different from the first perceptible warning signal if the activation signal indicates movement of the ball of the crane in a second direction.

92. A method of warning of movement of a ball of a crane, comprising:

receiving an activation signal indicating actuation of an electromechanical component for moving a ball of a crane; and in response to receiving the activation signal, generating a perceptible warning signal.

93. The method of claim 92, wherein the electromechanical component is a hydraulic system of the crane used to move the crane ball.

94. The method of claim 92, wherein the electromechanical component is an electronic control system of the crane that controls movement of the crane ball.

95. The method of claim 92, further including wirelessly receiving the activation signal.

96. The method of claim 92, further comprising generating a visual perceptible warning signal.

97. The method of claim 92, further comprising generating an audible perceptible warning signal.

98. The method of claim 97, further comprising generating a visual perceptible warning signal.

99. A method of warning of movement of a ball of a crane, comprising:

receiving an activation signal indicating actuation of an electromechanical component for moving a ball of a crane; and if the activation signal further indicates actuation of an electromechanical component for moving a boom of a crane or a cable supporting a ball of the crane, then generating a first perceptible signal; and if the activation signal further indicates actuation of an electromechanical component for moving a cab of a crane, the generating a second perceptible signal different from the first perceptible signal.

100. The method of claim 99, further comprising wirelessly receiving the activation signal.

101. The method of claim 99, further comprising generating the first perceptible signal at the ball of the crane.

102. The method of claim 99, further comprising generating the second perceptible signal at a counterweight of the crane.

* * * * *